US008157327B2

(12) United States Patent
Tomasi

(10) Patent No.: US 8,157,327 B2
(45) Date of Patent: Apr. 17, 2012

(54) HIGH CHAIR

(75) Inventor: Liviano Tomasi, Sovizzo (IT)

(73) Assignee: L'Inglesina Baby S.p.A., Altavilla Vicentina (IT)

( * ) Notice: Subject to any disclaimer, the term of this patent is extended or adjusted under 35 U.S.C. 154(b) by 136 days.

(21) Appl. No.: 12/225,588

(22) PCT Filed: Mar. 27, 2007

(86) PCT No.: PCT/EP2007/002686

§ 371 (c)(1),
(2), (4) Date: Sep. 25, 2008

(87) PCT Pub. No.: WO2007/112883

PCT Pub. Date: Oct. 11, 2007

(65) Prior Publication Data

US 2009/0295198 A1 Dec. 3, 2009

(30) Foreign Application Priority Data

Mar. 30, 2006 (IT) ..... VR2006A0060

(51) Int. Cl.
*A47C 1/00* (2006.01)

(52) U.S. Cl. ..... 297/344.14; 297/148; 297/326; 297/344.18; 297/451.3

(58) Field of Classification Search ..... 297/16.1, 297/51, 52, 148, 153, 344.14, 344.18, 326, 297/327, 451.3, 160, 161
See application file for complete search history.

(56) References Cited

U.S. PATENT DOCUMENTS

| | | | | |
|---|---|---|---|---|
| 2,692,637 | A * | 10/1954 | Rainwater | 297/344.18 |
| 2,976,911 | A * | 3/1961 | Barker | 297/40 |
| 4,958,885 | A * | 9/1990 | Kassai | 297/55 |
| 5,707,104 | A * | 1/1998 | Perego | 297/16.1 |
| 6,089,651 | A * | 7/2000 | Carmen | 297/16.1 |
| 6,854,800 | B2 * | 2/2005 | Perego | 297/148 |
| 2003/0218366 | A1 * | 11/2003 | Rho | 297/153 |

FOREIGN PATENT DOCUMENTS

| | | | |
|---|---|---|---|
| AU | 2006 201 381 | A1 | 10/2006 |
| CN | 1 535 636 | A | 10/2004 |
| CN | 2 705 076 | Y | 6/2005 |
| CN | 2 705 078 | Y | 6/2005 |
| CN | 2 705 079 | Y | 6/2005 |
| GB | 2 014 443 | A | 8/1979 |
| WO | WO 2006/072402 | A | 7/2006 |
| WO | WO 2006/130906 | A | 12/2006 |

* cited by examiner

*Primary Examiner* — David Dunn
*Assistant Examiner* — Philip Gabler
(74) *Attorney, Agent, or Firm* — Modiano & Associati; Albert Josif; Daniel O'Byrne

(57) ABSTRACT

A high chair, comprising a supporting structure, which is provided with a supporting element associated to one post arranged along a first longitudinal direction substantially starting from an end portion of the supporting element to define at least three resting regions, the one post supporting a respective coupling element which supports a seat which forms a sitting surface, elements being provided for blocking the coupling elements with respect to the respective post in order to adjust the distance between the seat and the supporting element; the supporting element being articulated so that it can rotate, substantially at the end portion, to the post in order to pass from an extended condition, in which the supporting element is angularly spaced with respect to the respective post to a folded condition in which the supporting element is angularly closer to the respective post.

22 Claims, 15 Drawing Sheets

HIGH CHAIR

BACKGROUND OF THE INVENTION

The present invention relates to a high chair.

Currently, high chairs for babies are generally constituted by a supporting structure for a seat, which is designed to accommodate the child and can generally be associated with a table or tray, which can optionally be tilted and/or removed and is designed to support the plate and/or cup, and at the same time, in some cases, prevents the child from falling forward.

In many cases, the supporting structure is constituted by two lateral posts, which are substantially triangular and are optionally connected one another by means of one or more interconnection cross-members.

The seat is often slidingly associated, at lateral tube-shaped portions thereof, with a respective sleeve element, in practice one side of the triangle that constitutes each lateral post, in order to allow to arrange the seat at different heights from the ground.

Of course, in this case there are means of different types for locking the seat with respect to the posts or rather with respect to the sleeve elements, so as to ensure maximum safety and stability of the high chair during use.

High chairs are also commercially available in which the supporting structure is constituted by two lateral elements, which also are generally interconnected by means of one or more interconnection cross-members, each of which has a supporting base, which is designed to rest on the ground during use, and a post element which protrudes from each supporting base along a direction which is inclined with respect to said base.

The seat is associated, at its lateral portions, with a tubular receptacle, which is slidingly associated with each post element. In this case also, there are means for locking the seat, or rather the tubular receptacles associated therewith, with respect to the respective post element.

As an alternative, at the post elements it is possible to provide a plurality of locking guides, constituted for example by recesses which lie, during use, substantially horizontally and are spaced along the longitudinal direction of such post elements: such locking guides can be engaged by lateral engagement portions, which are supported by the sitting surface of the seat so as to allow to adjust the height of the sitting surface with respect to the ground.

Although the described high chairs are widespread and widely used, they suffer drawbacks.

First of all, it is observed that when the seat is arranged at a lower level than the maximum allowed one, the portion of the post elements that protrudes upwardly with respect to the seat is often a hindrance and an obstacle to the parent while feeding the child and/or an inconvenience or a danger factor for the child, which may hit its head or get its hands caught.

Moreover, some types of high chairs are bulky once folded up.

Moreover, it has been found that although the high chairs described above allow to tilt the seat, this operation is often problematic and awkward, since the rotation, by occurring at the sitting surface, produces a vertical movement of the crotch support, which in some ways can interfere with the table or tray.

SUMMARY OF THE INVENTION

The aim of the present invention is to eliminate or at least reduce drastically the drawbacks noted above in conventional high chairs.

Within this aim, an object of the present invention is to provide a high chair which allows to change rapidly and effectively the height of the seat with respect to the ground.

Another object of the invention is to provide a high chair which is very easy to use.

Still another object of the invention is to provide a high chair which has a competitive production cost, so that its use is advantageous also from an economical standpoint.

This aim and these and other objects, which will become better apparent hereinafter, are achieved by a high chair as disclosed in the appended claims.

BRIEF DESCRIPTION OF THE DRAWINGS

Further characteristics and advantages of the invention will become better apparent from the description of some preferred but not exclusive embodiments of a high chair according to the invention, illustrated by way of non-limiting example in the accompanying drawings, wherein.

DESCRIPTION OF THE PREFERRED EMBODIMENTS

In the following exemplary embodiments, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

Figure 1:
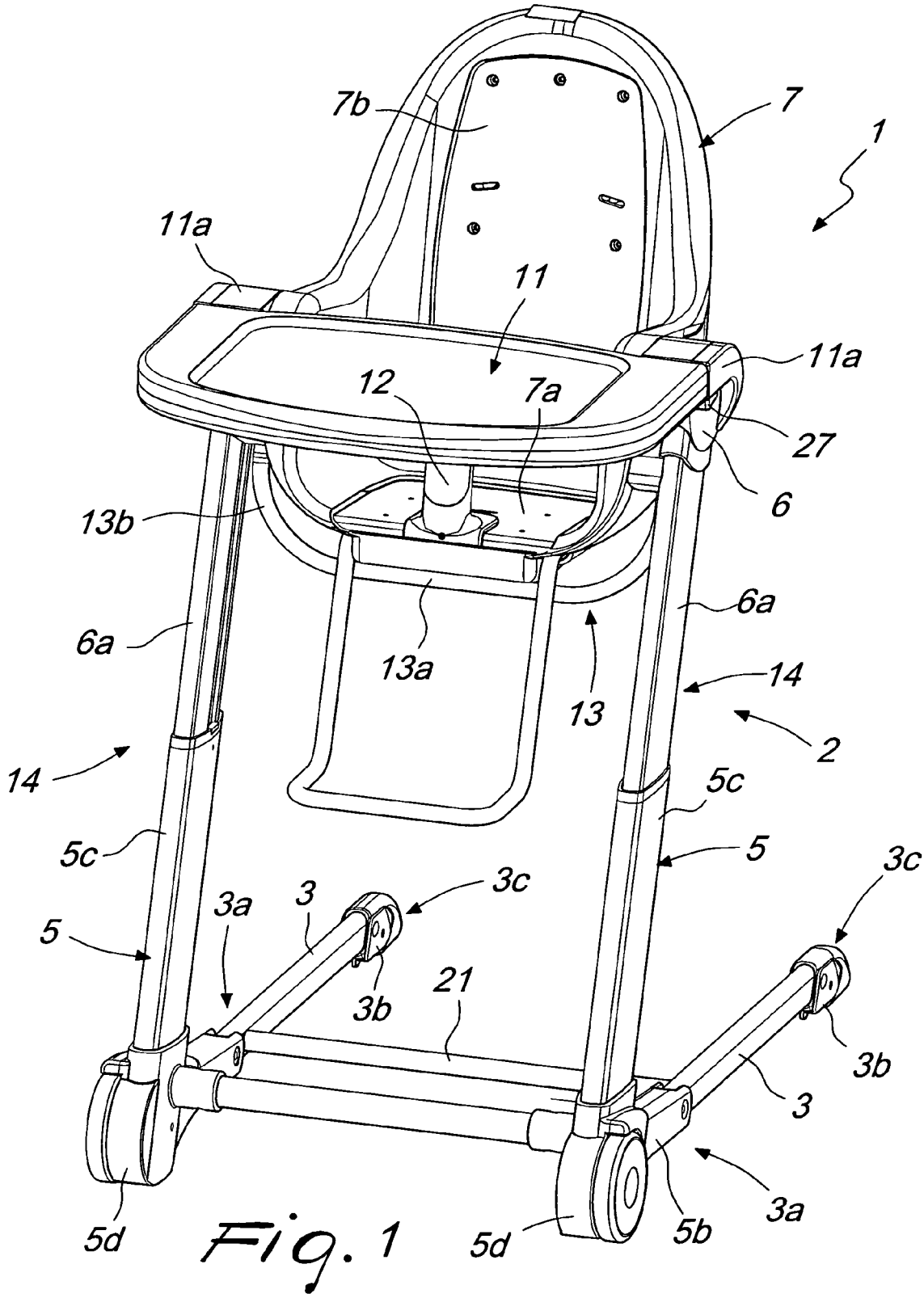
FIG. 1 is a perspective view of a high chair according to the invention.
Figure 2:
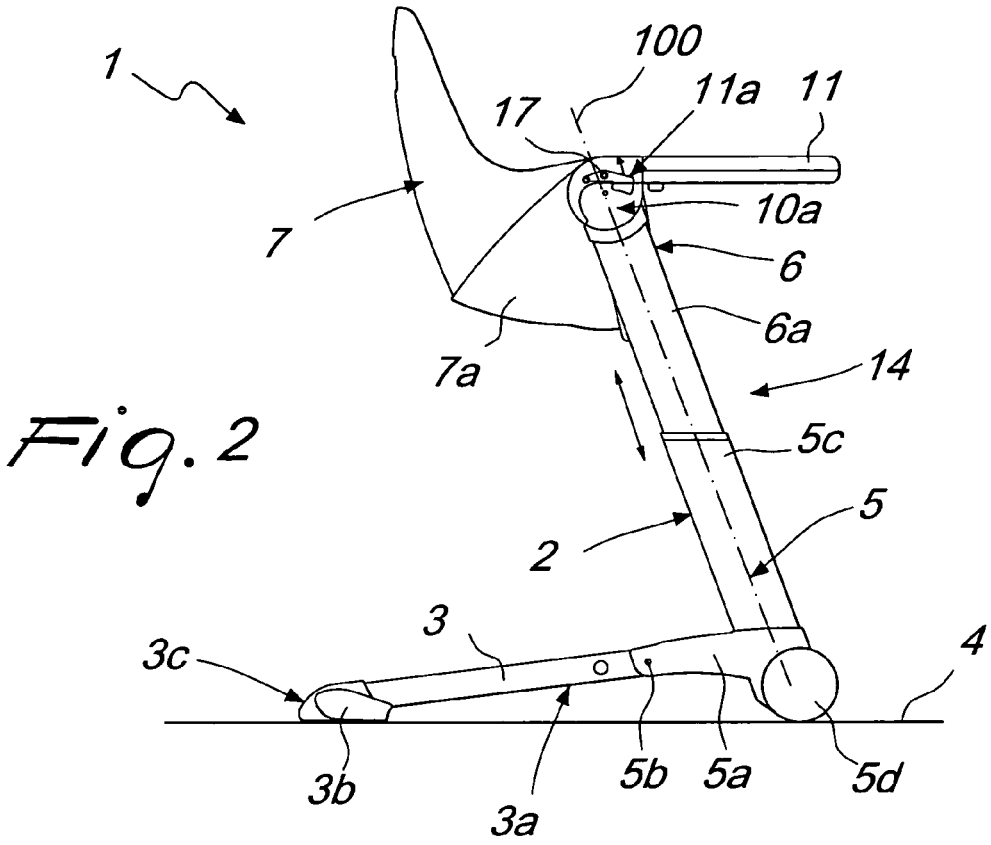
FIG. 2 is a side elevation view of a high chair.

With reference to the figures, and first of all to the side elevation view shown in FIG. 2, a high chair, generally designated by the reference numeral 1, comprises a supporting structure 2, which has at least one supporting element associated to at least one post 5 and that cooperate to define at least three resting regions. Advantageously, the supporting structure 2 comprises two supporting elements 3 which have, during use, at least one region for resting on the supporting surface 4, such as can be, for example, the floor of a home.

Advantageously, the supporting structure 2 comprises, in addition, at least one and preferably two posts 5, which protrude respectively from a first end portion 3*a* of the supporting elements 3.

In particular, the posts 5 lie along a first longitudinal direction 100, which during use is inclined with respect to the plane of arrangement of the supporting surface 4 and typically with respect to the direction of the longitudinal extension of the supporting elements 3, so that between the supporting elements 3 and the respective post 5 there is an acute angle $\alpha$.

Each post 5 supports a respective coupling element 6, which in turn supports, typically at the lateral sides, a seat 7 which defines a sitting surface 7*a* for a child.

The high chair 1 is further provided with means 8 for locking the coupling elements 6 with respect to the respective post 5, so as to allow an adjustment of the distance between the seat 7 and the supporting elements 3 and therefore in practice of the seat 7 with respect to the floor 4.

Figure 4:
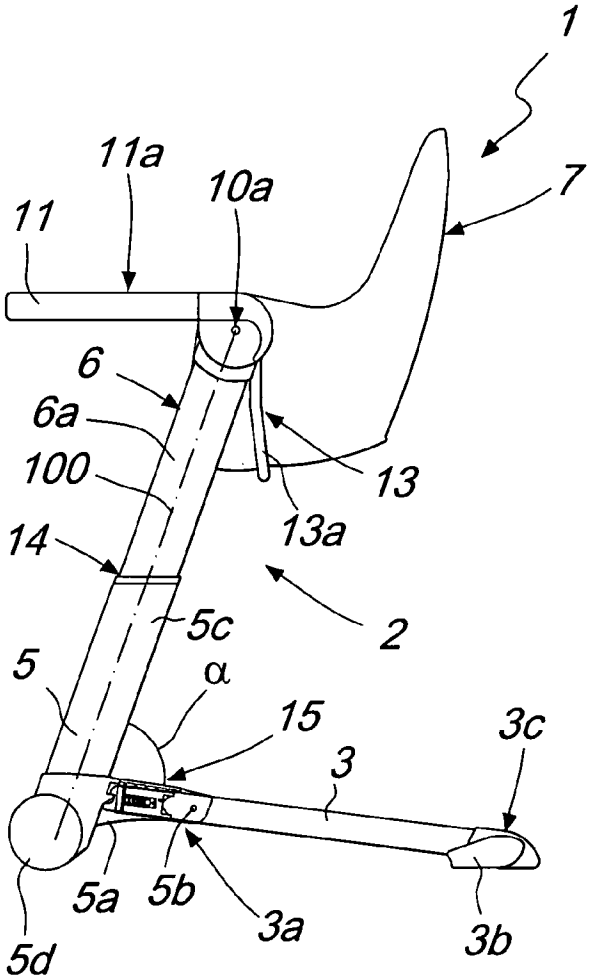
FIG. 4 is a side elevation view of a high chair with the seat fully spaced from the supporting surface and in which part of the outer enclosure of the post has been removed for the sake of greater clarity.
Figure 10:
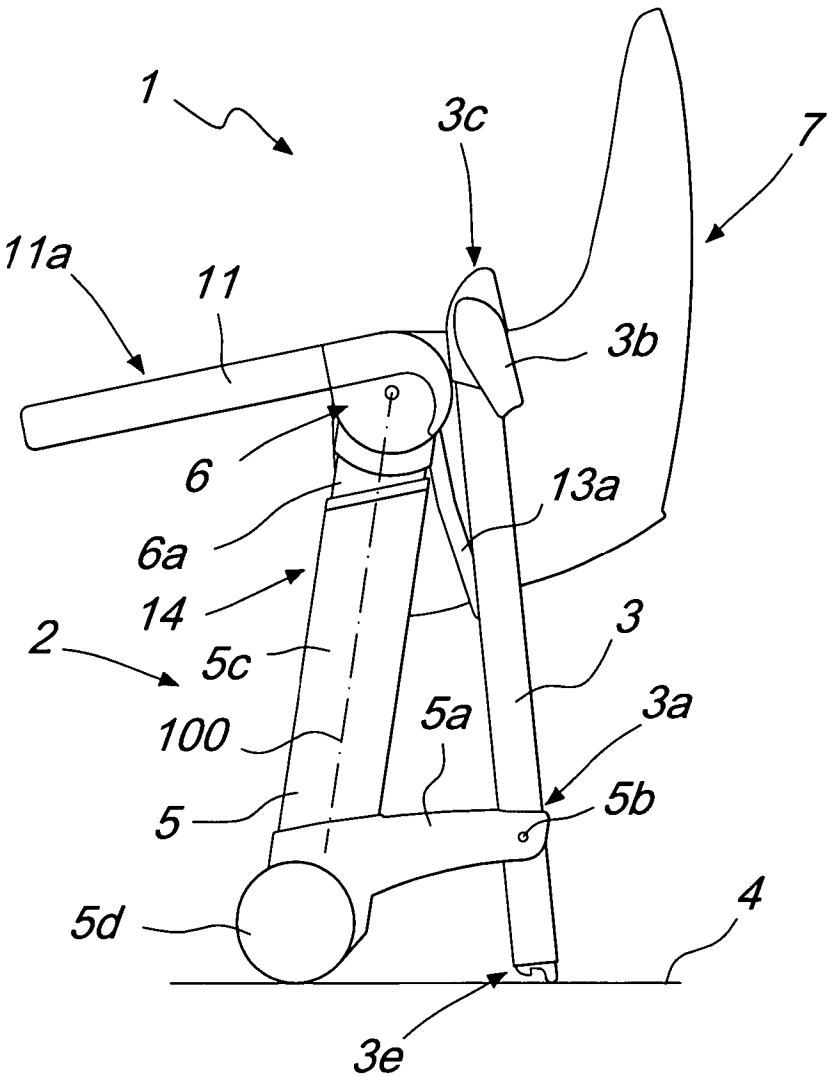
FIG. 10 is a side elevation view of the high chair in the folded condition.

According to a first aspect of the present invention, the supporting elements 3 are rotatably articulated, substantially at respective end portions thereof 3*a*, to the posts 5 in order to pass from an extended condition, shown for example in FIG. 4, in which the supporting elements 3 are angularly spaced from the respective posts 5, to a folded condition, shown in FIG. 10, in which the supporting elements 3 are angularly closer to the respective posts 5.

Figure 7:
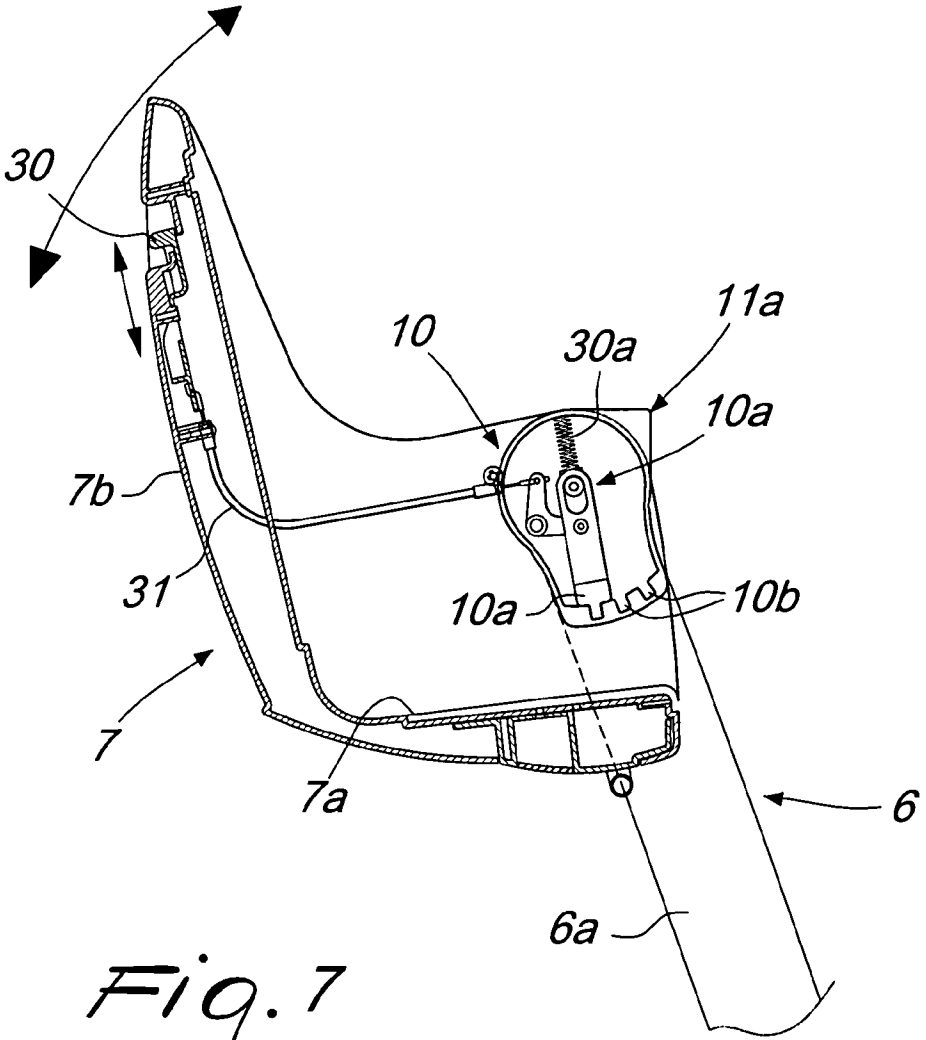
FIG. 7 is a sectional view, shown partially in phantom lines, of a seat associated with the locking means.
Figure 8:
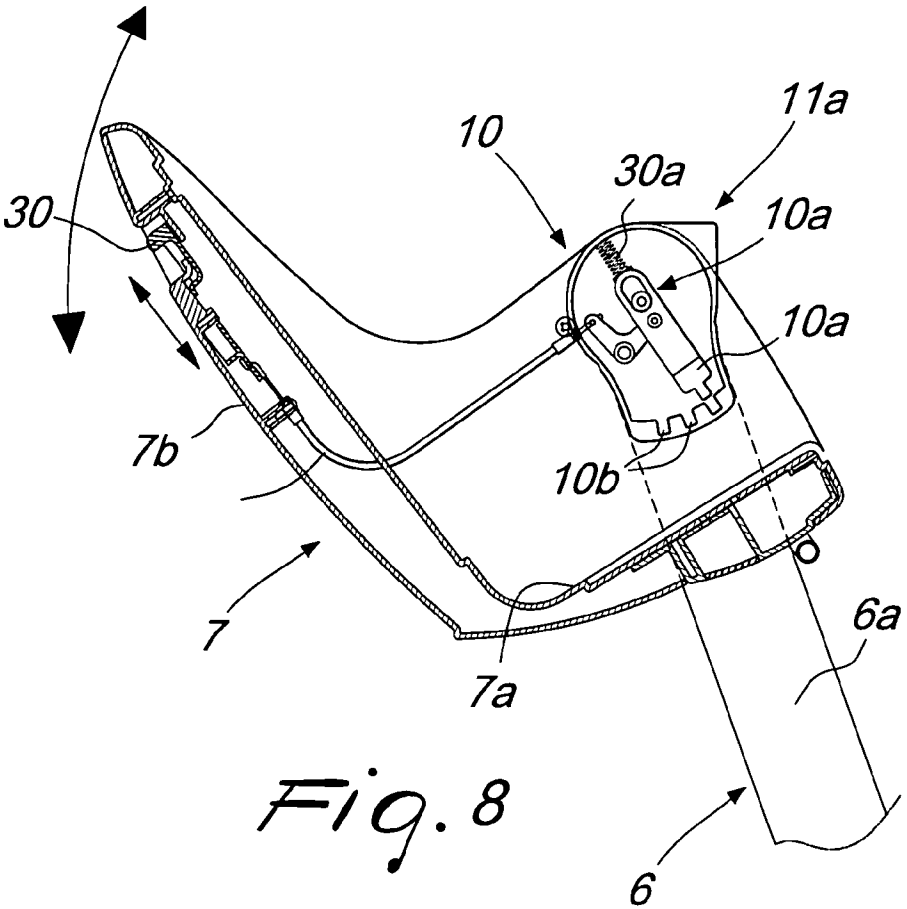
FIG. 8 is a sectional view, similar to FIG. 7, with the seat inclined in a different manner with respect to the supporting structure.

According to a further aspect, and with particular reference to the embodiment shown in FIGS. 7 and 8, the present invention relates to a high chair 1, which comprises a supporting structure 2 which has at least one supporting element 3, advantageously two, and a pair of coupling elements 6, which can move with respect to the supporting elements 3; the coupling elements 6 support, so that it can rotate about a rotary coupling axis 101, typically a predominantly horizontal axis, the seat 7 which defines the sitting surface 7*a*.

The high chair 1 is provided with locking means 10, which act between the seat 7 and the coupling elements 6 in order to block the rotation of the seat 7 with respect to the coupling elements 6 and therefore with respect to the supporting structure 2 about the rotary coupling axis 101.

In particular, according to an important aspect of the present invention, the rotary coupling axis 101 is substantially parallel and spaced with respect to the sitting surface 7*a* and, as shown in the figures, is arranged on the side of the concavity of the sitting surface 7*a*.

Conveniently, said rotary coupling axis 101 can be arranged substantially proximate the regions 11*a* for connection between the seat 7 and a respective supporting table 11.

Advantageously, the rotary coupling axis 101 is substantially proximate to the free end 12*a* of a crotch support 12 which is associated with the seat 7.

This causes, during the operations for tilting the seat 7, the retention of a substantially equal height between the free end 12*a* of the crotch support 12 and the supporting table 11, ensuring higher safety against the risk of nipping the child.

In order to allow quick and effective adjustment of the inclination of the seat 7 with respect to the supporting structure 2, the back 7*b* of the seat 7 is associated with an actuation handle 30, which is connected to the locking means 10 by means of kinematic interconnection means, such as a sheathed cable 31.

In this regard, with particular reference to the embodiment shown in FIGS. 7 and 8, the locking means 10 can be provided for example by providing a retention body 10*a*, which is rigidly rotationally associated with the seat 7 about the rotary coupling axis 101.

On each coupling element 6 there is a set of teeth provided by a plurality of complementarily shaped seats 10*b*, which are mutually angularly spaced about the rotary coupling axis 101 and can be engaged selectively by said retention body 10*a*.

In particular, following the actuation of the actuation handle 30, the retention body 10*a* can be disengaged, by way of its spacing in contrast with the action of a pusher spring 30*a*, from said set of teeth, so as to allow the free rotation of the seat 7 with respect to the supporting structure 2 about the rotary coupling axis 101.

By then releasing the handle 30, the action of the pusher spring 30*a* tends to return the retention body 10*a* toward the set of teeth and therefore produces insertion within a respective complementarily shaped seat 10*b*.

According to a particularly important aspect of the present invention, the high chair 1 has, as clearly shown in the figures cited above, telescopic means 14 which act between the coupling elements 6 and the respective posts 5 and are adapted to adjust the distance between the supporting elements 3 and the seat 7.

The telescopic means 14 can be provided by providing for the presence of a respective elongated element 6*a*, which protrudes from the coupling elements 6 along the first longitudinal direction 100 and is associated slidingly with a respective tubular portion 5*c*, which is defined by the post 5 and is arranged coaxially to the respective elongated element 6*a*.

Figure 3:
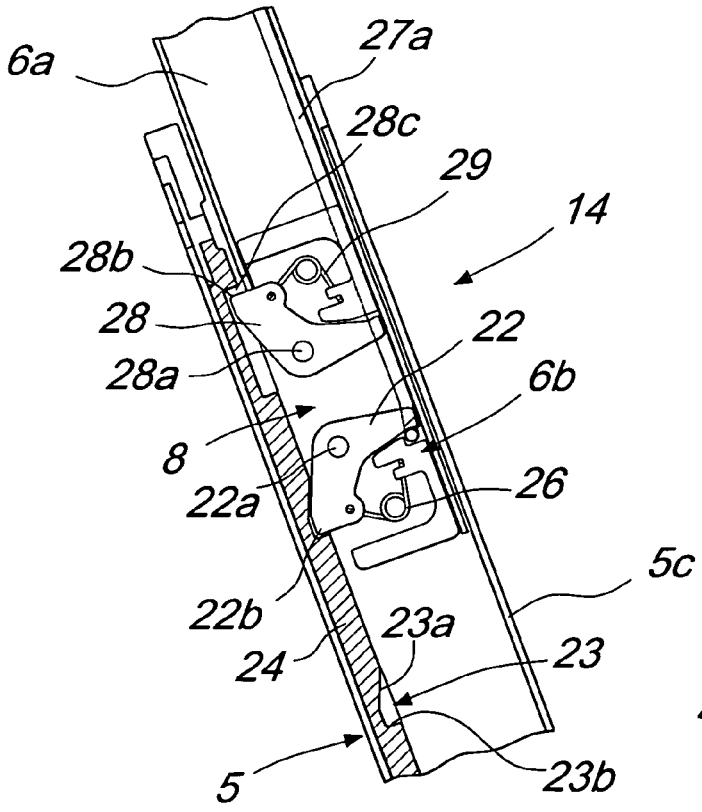
FIG. 3 is a sectional side elevation view of the high chair at the coupling between the post and the coupling element.
Figure 5:
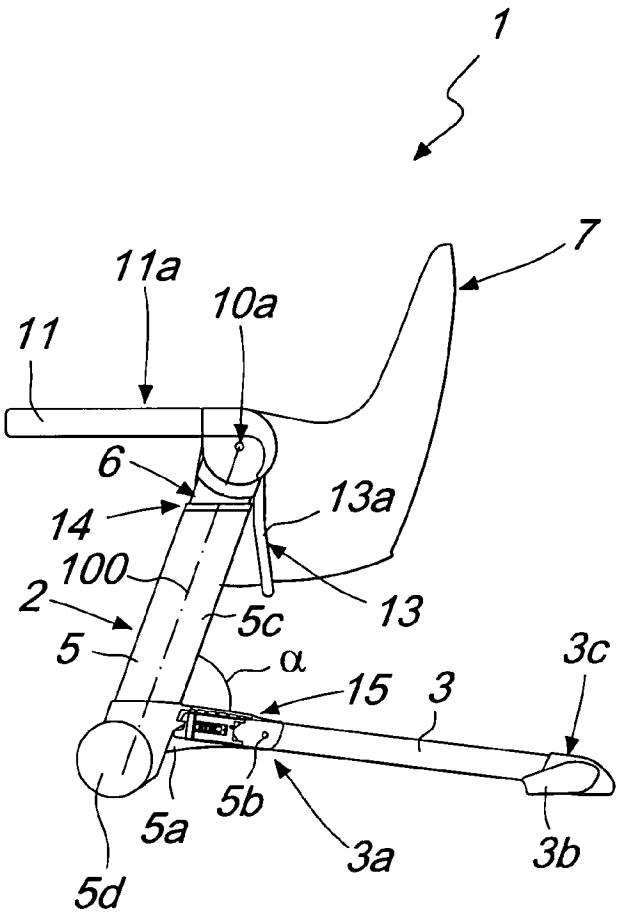
FIG. 5 is a view, similar to FIG. 4, with the seat moved completely toward the supporting surface and in which part of the outer enclosure of the post has been removed for the sake of greater clarity.

With particular reference to the sectional view shown in FIG. 3, the locking means 8 comprise a locking element 22, which is articulated to a respective coupling element 6 and in particular is supported so that it can rotate, at an intermediate portion thereof, by a supporting pin 22*a* which is supported by the lower end of the elongated element 6*a*.

The locking element 22 has a locking tooth 22*b*, which can engage within a plurality of insertion receptacles 23 formed on an engagement portion 24 which is associated with the respective post 5: the insertion receptacles 23 are advantageously spaced along the first longitudinal direction 100.

Elastic means 26, such as a trap spring, are provided between the locking element 22 and the respective coupling element 6 and are adapted to keep the locking tooth 22*b* pressed against the engagement portion 24.

The insertion receptacles 23 have an inclined portion 23*a* and an abutment portion 23*b*, which is arranged substantially at right angles to the first longitudinal direction 100 so as to allow the sliding of the locking tooth 22*b* with respect to the engagement portion 24 when the coupling elements 6, and therefore the seat 7, are moved away from the supporting elements 3 and at the same time prevent the accidental mutual approach of the seat 7 toward the supporting elements 3 by means of the engagement of the locking teeth 22*b* with the respective abutment portions 23*b*.

Advantageously, the engagement portion 24 can be inserted in a containment slot 25, which is defined in the respective post 5 and in particular on the inner surface of the tubular portion 5*c*. In this manner, the insertion receptacles 23 are not visible to the user, with a consequent improved overall appearance of the high chair 1.

Moreover, it is possible, while keeping the structure of the posts 5 substantially unchanged, to associate, according to the specific requirements, with said posts 5 engagement portions 24 which have variously mutually spaced insertion receptacles 23.

Each locking element 22 is connected kinematically, by way of per se known means, such as a sheathed cable or a tension element 27*a*, to a release device 22*c*, which is constituted for example by an actuation button 27, which, if actuated by the user, is designed to disengage the locking tooth 22*b* from the respective insertion receptacle 23 in order to allow the movement of the coupling elements 6 and in particular of the elongated elements 6*a* along the first longitudinal direction 100, thus allowing the movement of the seat 7 toward the supporting elements 3.

It is further possible for the elongated elements 6*a* to support rotatably a stop element 28, which is pivoted about a fulcrum 28*a* which is oriented at right angles to the first longitudinal direction 100. The stop element 28 defines a stop head 28*b*, which is kept in contact with the respective engagement portion 24 by way of the action of a spring 29.

The stop head 28*b* is shaped so as to allow, also thanks to the fact that the stop element 28 can oscillate about the fulcrum 28*a*, the sliding of such stop element 28 on the engagement portion 24 in both directions of relative sliding along the first longitudinal direction 100 at least in the region affected by the presence of the insertion receptacles 23. It should be noted that an abutment 28*c* is provided above said region affected by the presence of the insertion receptacles 23 and is directed toward the supporting elements 3; the stop head 28*b* rests against said abutment in order to prevent the extraction of the elongated elements 6*a* from the respective tubular portion 5*c*.

Figure 14:
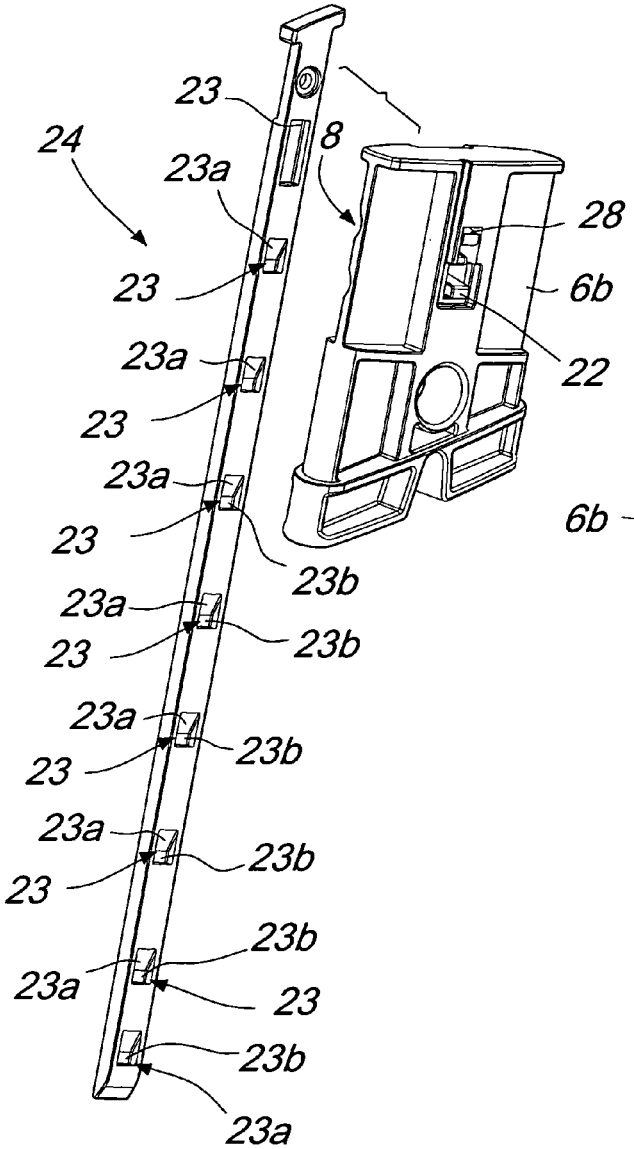
FIGS. 14 and 15 are exploded perspective views, taken from two different viewpoints, of a supporting block and of the corresponding engagement portion.
Figure 15:
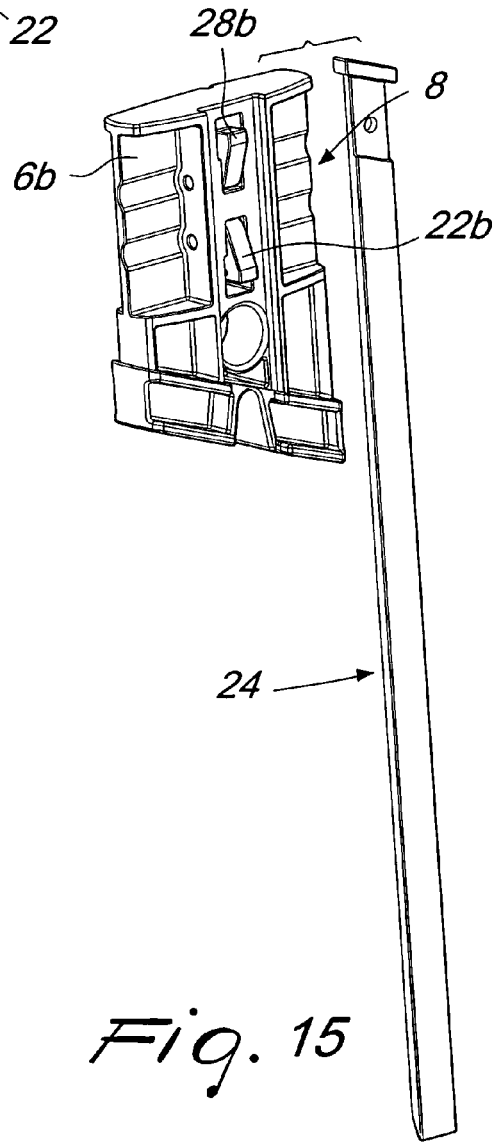
Figure 16:
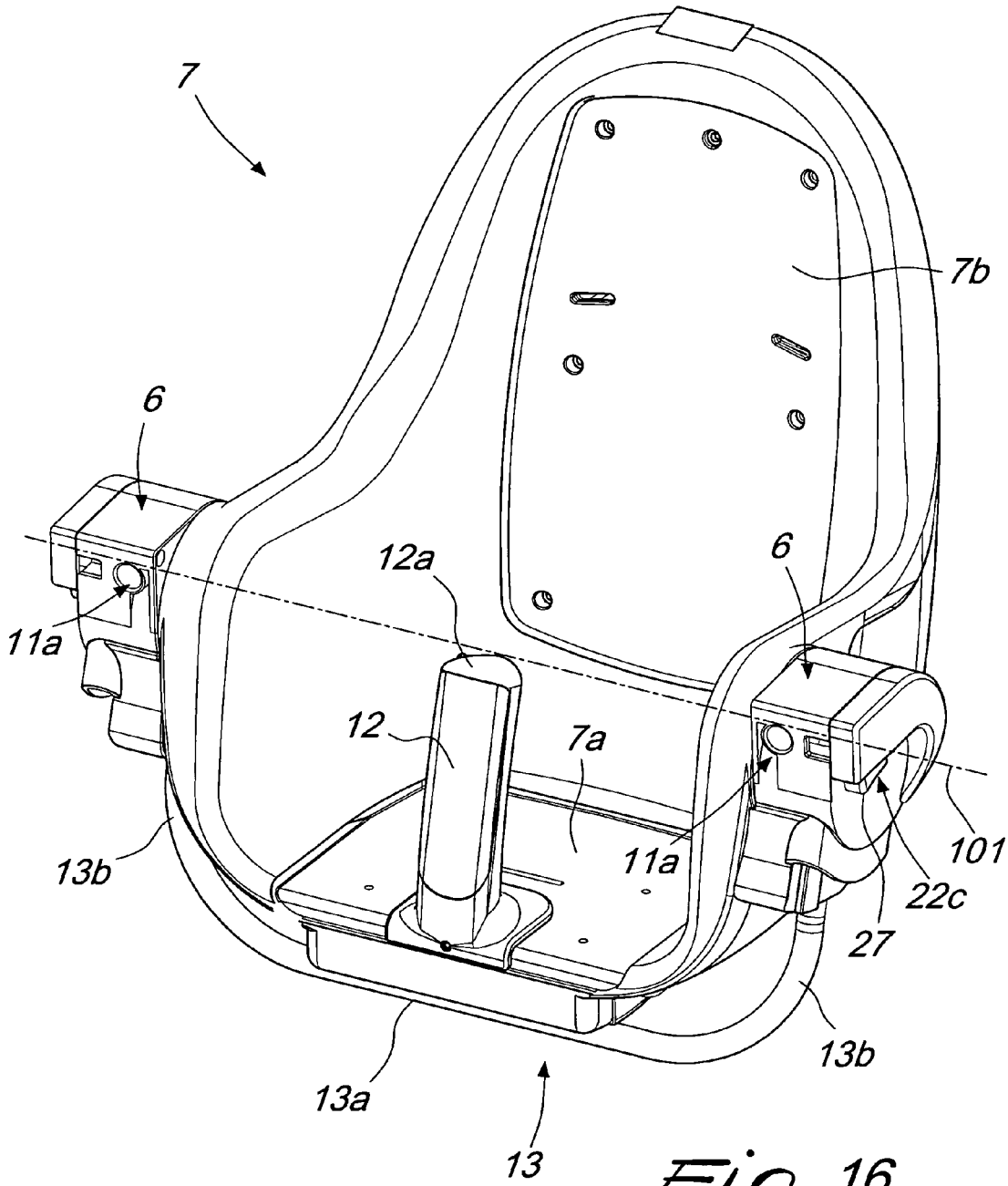
FIG. 16 is a perspective view of a seat.

Advantageously, as shown in the exploded views of FIGS. 14 and 15, it is possible to provide a supporting block 6*b*, which can be associated with the lower end of each elongated element 6*a* and supports both the locking element 22 and the stop element 28 about the respective oscillation axes.

Figure 9:
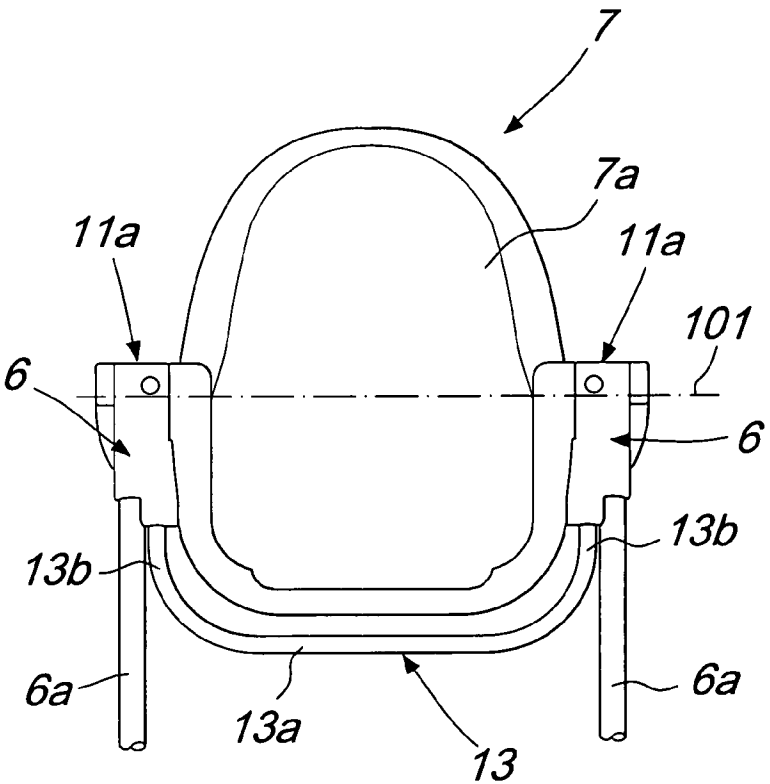
FIG. 9 is a front elevation view of the upper portion of a high chair.

With particular reference now to the front elevation view shown in FIG. 9, one can see that the high chair 1 has an interconnection cross-member 13 between the two coupling elements 6, which is designed to stiffen the portion which lies upwardly, during use, of the supporting structure 2.

Conveniently, the interconnection cross-member 13 is U-shaped and defines two end portions 13*b* which during use lie along a substantially vertical direction, and an intermediate connecting portion 13*a*, which during use lies substantially horizontally and is arranged below the seat 7.

With particular reference to the high chair 1 provided with telescopic means 14, it can in fact be noted that this choice allows to achieve an adequate stiffening of the structure without however causing any hindrance to the sliding of the elongated elements 6*a* with respect to the tubular portions 5*c*.

Figure 11:
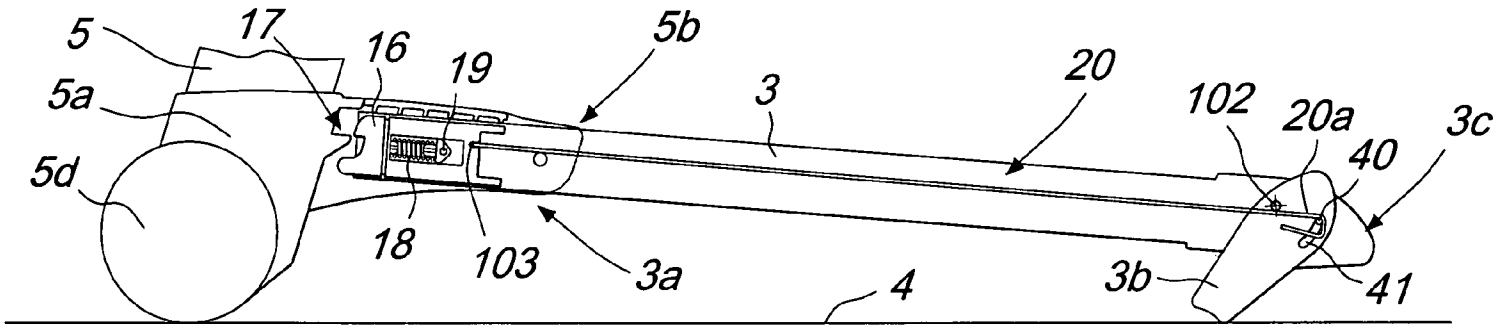
FIG. 11 is a front elevation view, partially in phantom lines, of a supporting element with the supporting foot in the locking position.
Figure 12:
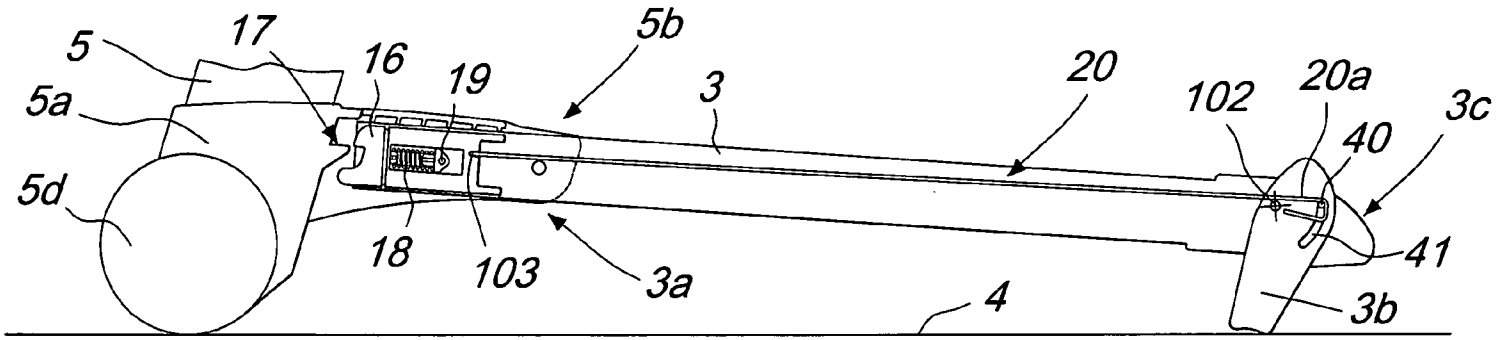
FIG. 12 is a front elevation view, partially in phantom lines, of a supporting element with the supporting foot in the release position.
Figure 13:
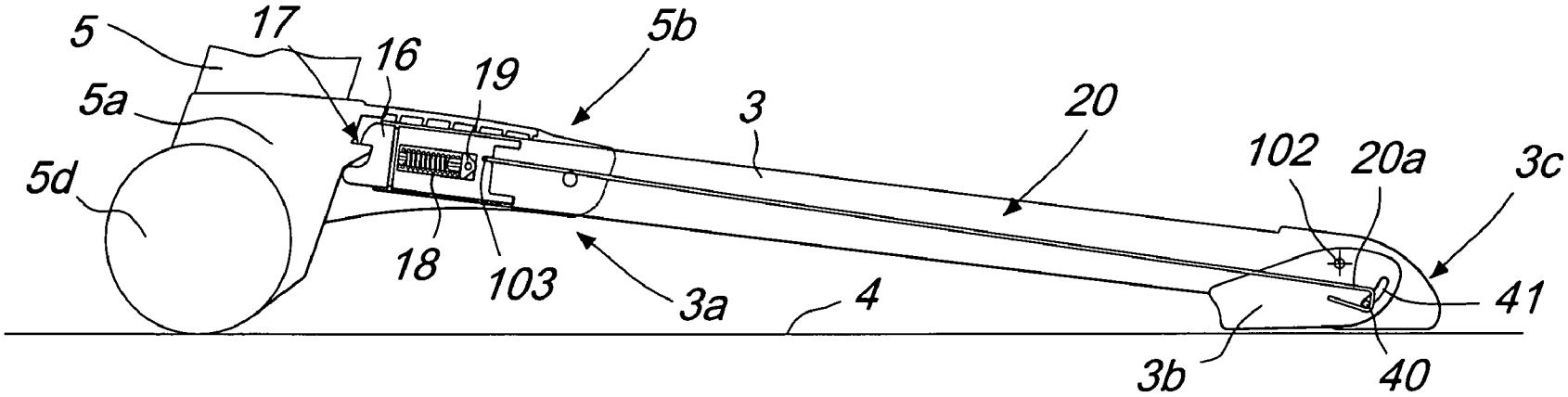
FIG. 13 is a front elevation view, partially in phantom lines, of a variation of the supporting element with the supporting foot in the locking position.

With particular reference to the sequence shown in FIGS. 11 to 13, the high chair 1 has means 15 for locking the relative rotation of at least one supporting element 3 and the respective post 5 in the extended condition.

The supporting elements 3 may further have at least one respective engagement foot 3*c*, which is arranged substantially at the end 3*b* which lies opposite the end portion 3*a*.

The posts 5 are associated with a connecting portion 5*a*, which is conveniently in a position which is spaced with respect to the supporting surface 4 and forms, with the respective post 5, an acute angle $\alpha$ and has a terminal portion 5*b* for pivoting to the end portion 3*a* of the respective supporting element 3.

Conveniently, between at least one post 5 or likewise between the connecting portion 5*a* and the respective supporting element 3 there act safety means, which are adapted to bring the high chair 1 to a folded condition, which therefore does not allow its use, if the locking means 15 are not activated correctly.

With reference to what is shown in the figures cited above, the safety means can be provided by ensuring that the center of gravity of the assembly composed of the elements, such as the posts 5, the seat 7 and the optional table 11, which are pivoted about the end portions 5*b* for pivoting to the supporting elements, is arranged between supporting feet 3*b* and the end pivoting portions 5*b*, so that its weight, regardless of the distance of the seat 7 from the supporting surface 4, applies to the assembly cited above a torque about the pivoting end portion 5*b* which tends to move the high chair 1 into the folded condition.

Figure 6:
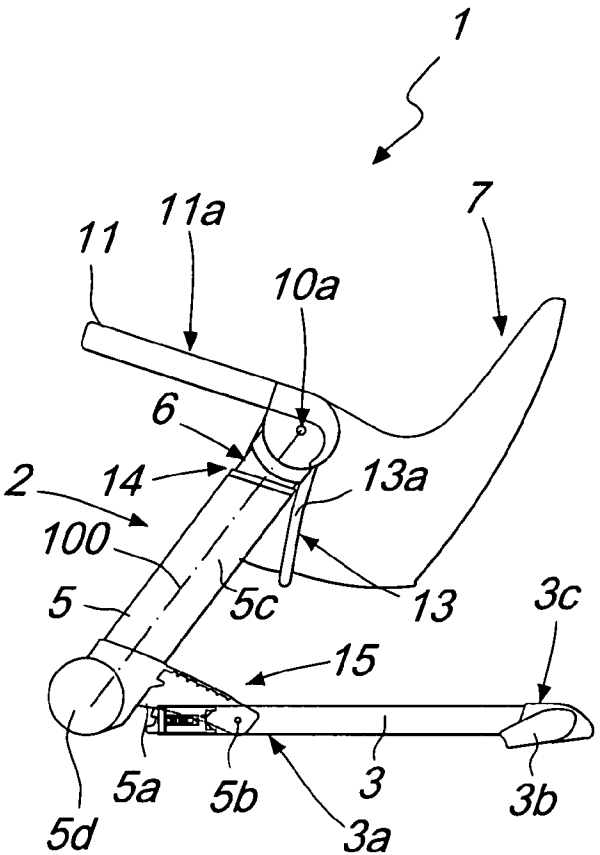
FIG. 6 is a side elevation view of a high chair with the seat moved fully toward the supporting surface, in which part of the outer enclosure of the post has been removed for the sake of greater clarity and in which the locking means are not correctly activated.

To ensure that the center of gravity of said assembly lies always beyond the point of the terminal pivoting portion 5*b*, the end pivoting portion 5*b* is raised with respect to the ground. In this manner, the first folding rotation shown in FIG. 6 moves the center of gravity of the assembly assuredly beyond the pivoting end portion 5*b*. If the locking means 15 are not activated correctly, the weight of the assembly causes the high chair 1 to automatically reach the folded condition.

Figure 17:
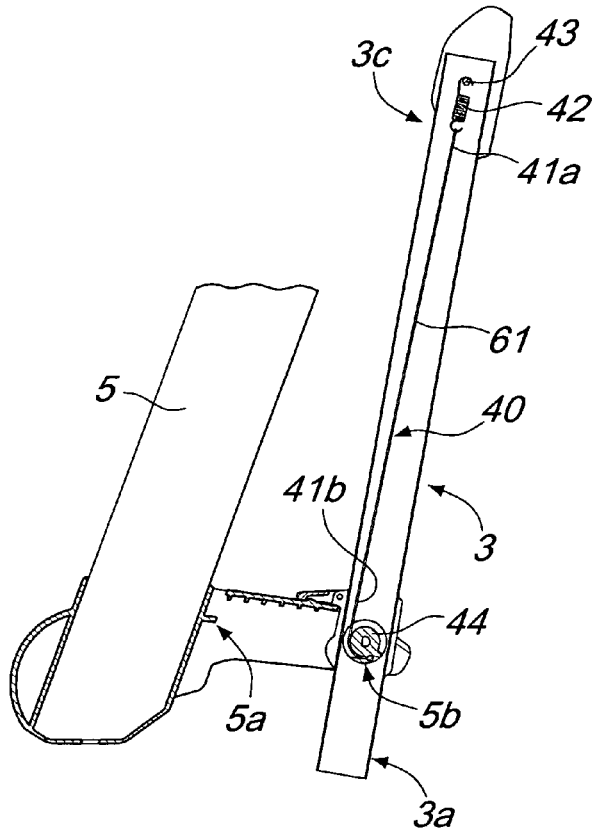
FIG. 17 is a partially sectional side elevation view of a portion of the high chair in the folded condition.
Figure 18:
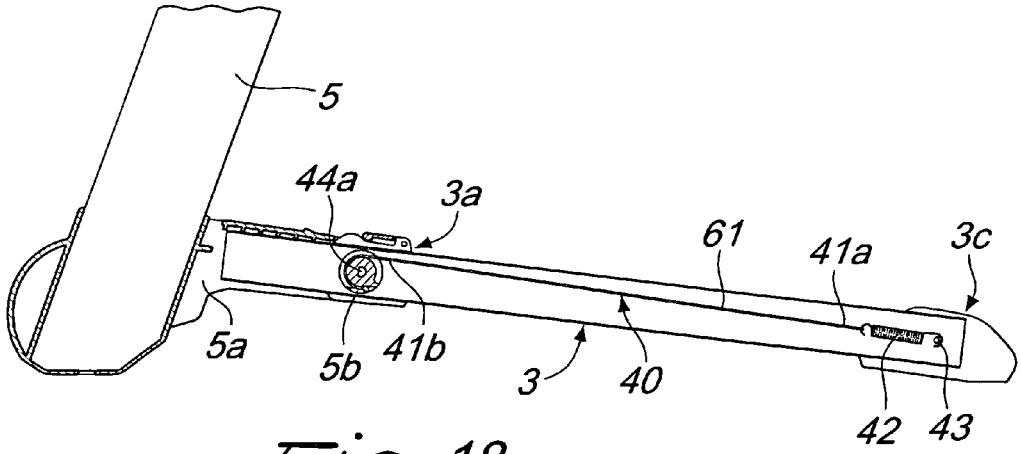
FIG. 18 is a view, similar to FIG. 17, but with the high chair in the open condition.

With particular reference to the embodiment shown in FIGS. 17 and 18, the safety means can comprise return means 44, which act between at least one of the pivoting end portions 5*b* and the respective supporting element 3.

In particular, the return means 44 are adapted to apply a force which tends to keep the high chair 1 in the folded condition.

In this regard, the return means 44 can be constituted for example by a cable 61 which is connected, at one of its ends 41*a*, to a spring 42, which in turn is connected to a connection pin 43 supported by the supporting element 3.

The other end 41*b* of the cable 61 winds around a pawl 44*a*, which is supported by the end pivoting portion 5*b*.

Thus, when the supporting elements 3 are folded down, the pawl 44*a* is fixed in rotation with respect to the post 5; accordingly, a portion of the cable 41*b* winds up on the pawl 44*a* tensioning the cable 41*a* and the spring 42.

The traction applied by the spring 42 to the cable 61 produces a torque which tends to keep the high chair 1 in the closed condition.

As an alternative, instead of the cable 61 associated with the spring 42 it is possible to provide a torsion spring which is loaded so as to keep, as mentioned above, the high chair in the folded condition. Further, well known round springs, C-shaped springs or ribbon springs may also be used. In this way, if the means 15 for mutually locking the supporting elements 3 and the respective posts 5 are not activated correctly, the return means 44 (torsion spring) return the high chair 1 to the folded condition, consequently preventing its use if the locking means 15 are actuated incorrectly or incompletely.

The locking means 15 have at least one engagement element 16, which is supported by each supporting element 3 and is connected kinematically, according to a first embodiment, to the respective supporting foot 3*b*. Each engagement element 16 can engage stably a respective engagement seat 17 formed on the post 5 or equivalently on the interconnection portion 5*a* when the high chair 1 is moved to the extended condition, so as to prevent, in this condition, the possibility of relative rotation of the supporting elements 3 with respect to the posts 5.

Conveniently, elastic loading means 18, constituted for example by a spring, act between the engagement elements 16 and an abutment region 19 which is formed on the respective supporting element 3; said means are suitable to keep the engagement element 16 stably engaged with the respective engagement seat 17 when the high chair 1 is in the extended condition.

According to a preferred embodiment, the supporting feet 3*b* are supported, so that they can rotate, about a respective pivoting axis 102 by the respective supporting element 3, in order to pass from a locking position, when the supporting foot 3*b* rests against the supporting surface 4, to a release position, when the supporting foot 3*b* is raised from the supporting surface 4 and is turned by the user about the respective pivoting axis 102.

Kinematic connection means are provided between the supporting feet 3*b* and the respective engagement elements 16 and are constituted for example by a tension member 20; the kinematic connection means 20 are suitable to act, when the supporting feet 3*b* are moved by the user into the release position, in contrast with the elastic loading means 18, so as to disengage the respective engagement element 16 from the engagement seat 17, thus allowing the relative rotation of the supporting elements 3 with respect to the respective posts 5.

A pin 40 is provided on the supporting foot 3*b* and is connected to the end 20*a* of the tension member 20 which lies opposite the end connected to the engagement element 16 and is accommodated slidingly within a slot 41 which has the shape of a circular arc centered on the pivoting axis 102 and is formed at the end 3*c* of the supporting element 3.

Advantageously, the supporting feet 3*b* have an elongated shape and are pivoted to the opposite end portion 3*c* at one of their ends, so as to assume, in the locking condition, an orientation which is substantially parallel to the supporting surface 4, while in the release position (therefore raised from the supporting surface 4) they are inclined with respect to the supporting surface 4 so that the subsequent approach of the supporting element 3 toward the supporting surface 4 can cause the automatic transition of the supporting feet 3*b* to the locking position.

This allows first of all to limit to the extension of the slot 41 the rotation of the supporting feet 3*b* about the respective pivoting axis 102.

Moreover, in order to further increase safety and practicality in use, one of the two slots 41 (as shown in FIG. 13) is longer, so that when the supporting foot 3*b* turns about the pivoting axis 102, the pin 40 moves into a position in which the tension member 20 can apply to the supporting foot 3*b* a force which is directed so as to keep it stably in the release position.

This result is achieved by having one of the two slots 41 crossed by the plane that passes through the pivoting axis 102 and the connection point 103 between the tension member 20 and the engagement element 16.

Moreover, the supporting elements 3 define an end portion 3*a*, which is arranged on the opposite side of the supporting foot 3*b* with respect to the respective pivoting portion 5*b*.

Figure 19:
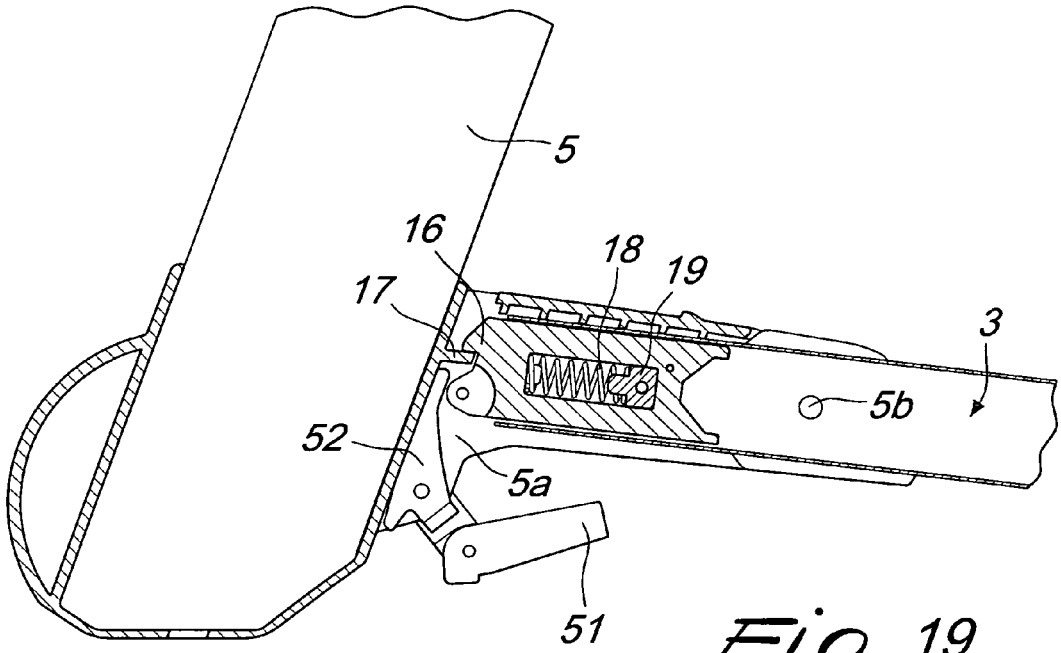
FIGS. 19 and 20 are sectional views of a portion of a high chair associated with the locking means.
Figure 20:
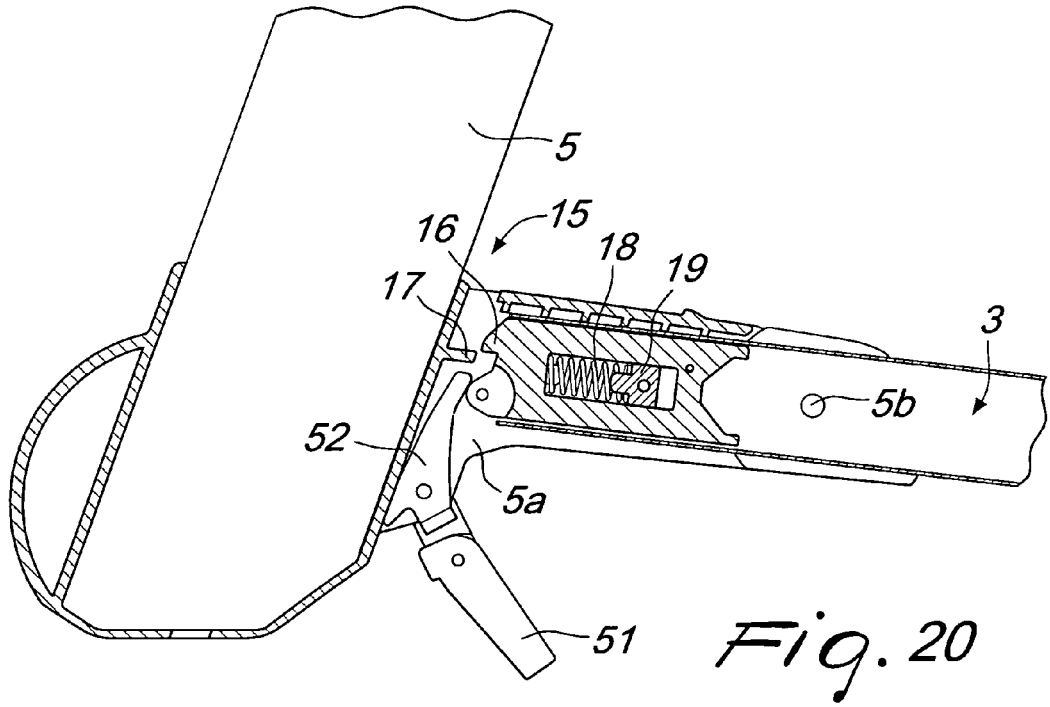
Figure 21:
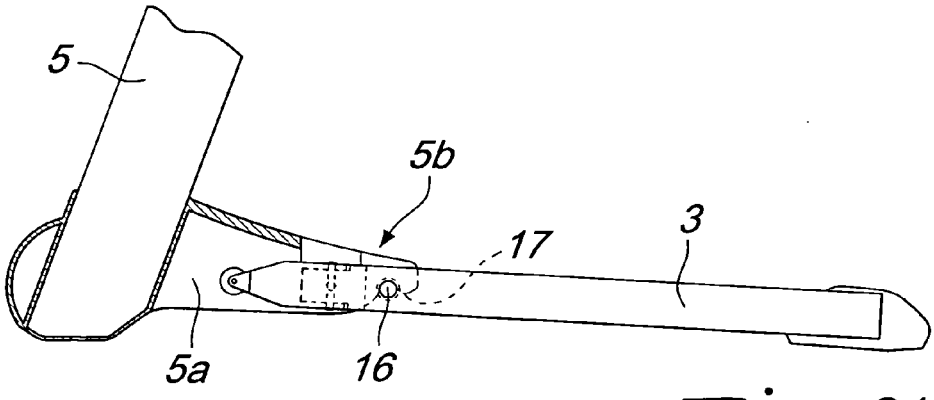
FIG. 21 is a side elevation view of a high chair portion associated with a variation of the locking means and with the high chair in the open condition.
Figure 22:
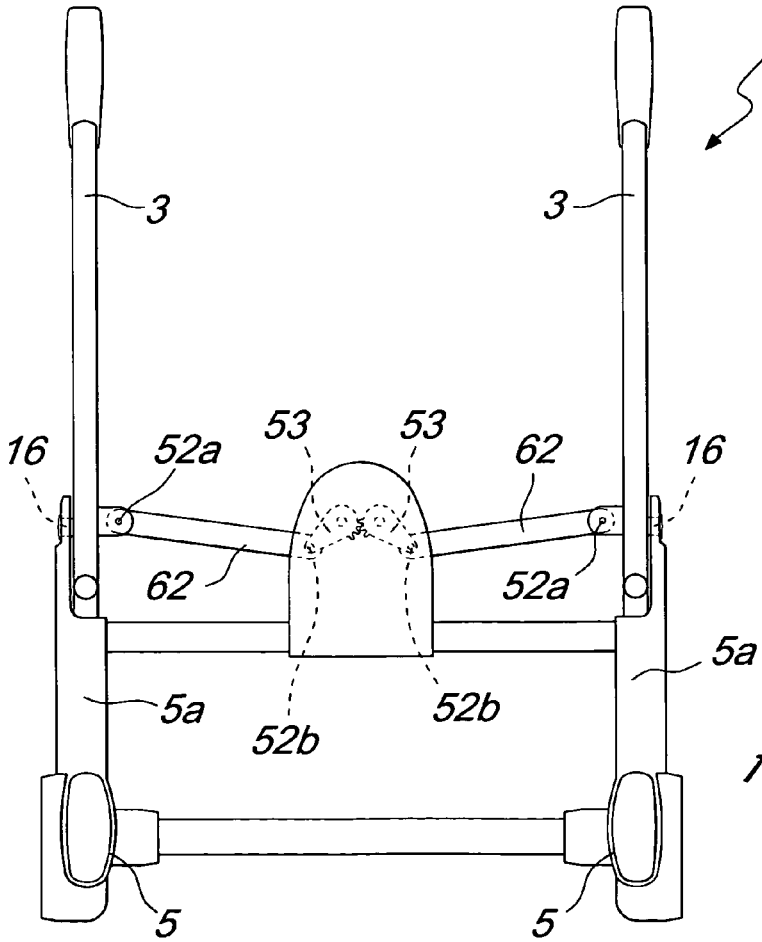
FIG. 22 is a top elevation view of the portion of high chair shown in FIG. 21.

According to another constructive variation shown in FIGS. 19 and 20, the locking means 15, at least as regards one of the assemblies constituted by a post 5 and a supporting element 3, can be constituted by an actuation lever 51, which is supported by the post 5 or equally by the end pivoting portion 5*b*. The actuation lever 51 is designed, when actuated, to disengage the engagement element 16 from the respective engagement receptacle 17.

As shown, actuation or movement of the actuation lever 51 is allowed only when the respective supporting element 3 is raised from the supporting surface; instead, when the supporting element 3 rests against the supporting surface (for example on the floor), it hinders its movement. In this manner, it is substantially impossible to disengage accidentally the engagement element 16 from the respective engagement receptacle 17.

In greater detail, the actuation lever 51, when turned, acts on a hook 52, which is designed to produce the translational motion of the engagement element 16 with respect to the respective engagement seat 17.

Advantageously, the actuation lever 51 comprises a first angular portion of free movement before the lever 51 engages the hook 52. For this reason a remarkable whole angular range can be defined. This requires much space for movement before disengaging the engagement element 16 from the respective engagement receptacle 17 and it is thus necessary to lift the high chair 1 from the supporting surface 4 to complete the move. This causes a precise sequence on the part of the user to be necessary if he/she wishes to perform the folding move and thus accidental moves are avoided.

According to another constructive variation, whose operating sequence is shown in FIGS. 21 to 25, the locking means 15 can be provided by providing for the supporting elements 3 to be fitted so that they can oscillate about a respective oscillation axis which is substantially perpendicular to the longitudinal axis of the respective supporting element 3 and advantageously substantially perpendicular to the plane which passes through the two supporting elements 3.

In this case also, it is convenient to provide safety means, which are adapted to prevent the oscillation of the supporting elements 3 when they are rested against the supporting surface.

Figure 23:
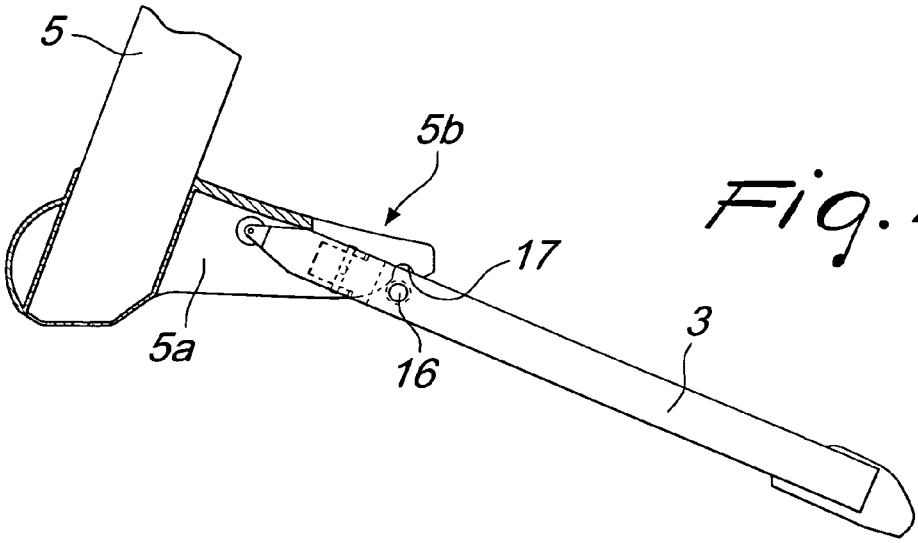
FIG. 23 is a view, similar to FIG. 21, but with the locking means in the release step.
Figure 24:
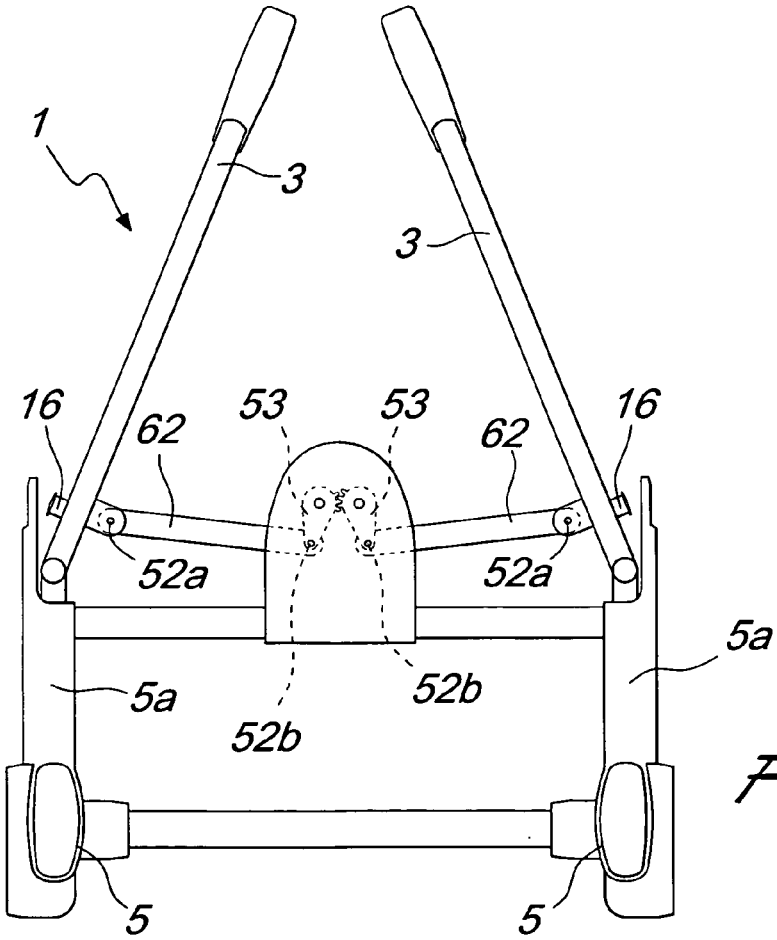
FIG. 24 is a top elevation view of the portion of high chair shown in FIG. 23.
Figure 25:
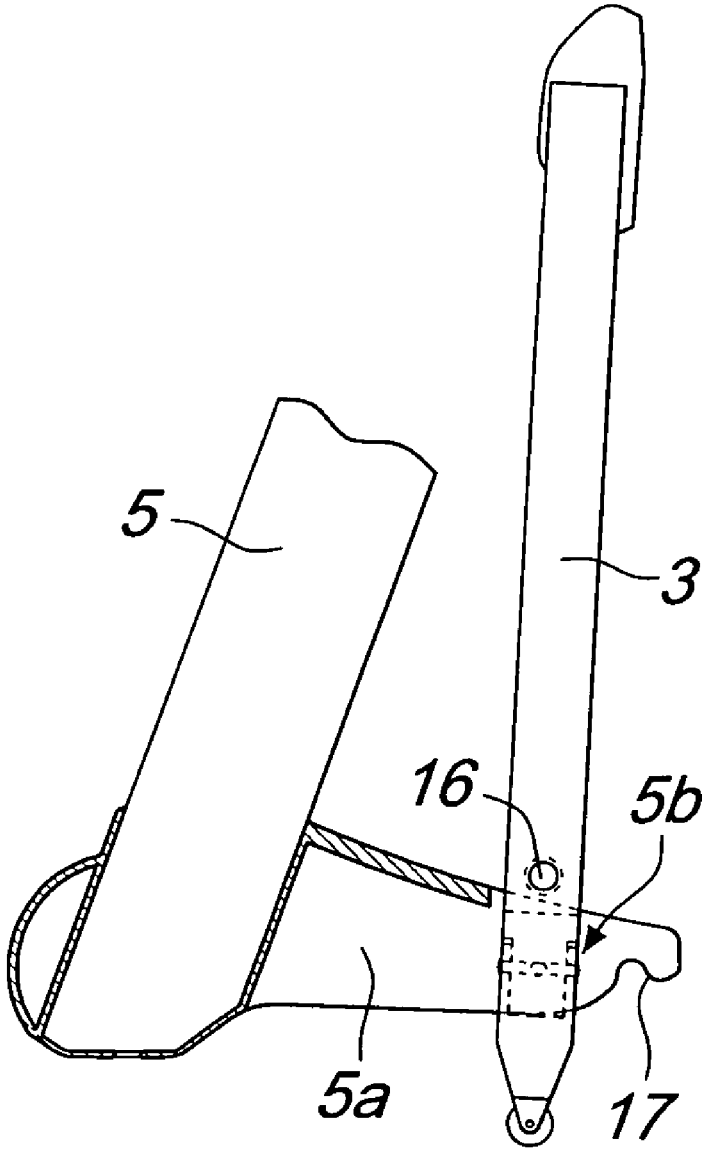
FIG. 25 is a view, similar to FIGS. 21 and 23, but with the high chair in the folded condition.

As shown in FIG. 23, oscillation is allowed as a consequence of a rotation of the supporting element 3 with respect to the respective end pivoting portion 5*b*, which tends to angularly space the supporting element 3 with respect to the respective post 5, while in normal operating conditions, i.e., with the child in the seat 7, the weight thereof tends to keep the engagement elements stable within the respective engagement receptacles.

As a consequence of the oscillation (on a substantially horizontal plane) the engagement element 16 is disengaged (which in this case has an enlarged head) from the respective engagement receptacle 17 defined at the end pivoting portion 5*b*. At this time it is possible to perform a rotation about the vertical axis which tends to move mutually closer the supporting elements 3, as shown in the top view of FIG. 24. At this time the engagement elements 16 do not interfere any more with the portion 5*b* and it is possible to cross such portions 5*b* with the supporting elements 3 in their upward movement so as to allow the transition of the high chair 1 from the extended condition to the folded condition shown in FIG. 25.

Also in this case, it is necessary for the user to perform a determined sequence of operations to carry out the folding, whereby the risk that accidental or not desired actions can lead the high chair to a folded position.

Conveniently, the two supporting elements 3 can be mutually interconnected by means of two interconnection arms 62, which have one of their ends 52*a* pivoted to the respective supporting element 3 and the other end 52*b* pivoted to a linkage 53, which is supported rotatably by a stiffening cross-member and engages the linkage 53 associated with the other interconnection arm 62.

In this way, it is evident that by moving just one of the two supporting elements 3 one obtains a symmetrical movement (with respect to the plane of symmetry of the high chair 1) of the other supporting element 3.

Moreover, according to a particularly important aspect of the present invention, the end portion 3*a* forms, when the high chair 1 is in the folded condition as shown clearly in FIG. 10, a rear supporting pad 3*e*, which is adapted to co-operate with a front supporting pad 5*d*, which is rigidly coupled to the post 5 in order to form a stable supporting base for the high chair 1 in the folded condition.

In particular, as shown, the front supporting pad 5*d* comprises a freely rotating wheel whose axis lies forward with respect to the first longitudinal direction 100.

Finally, the high chair 1 can be provided with a stiffening cross-member 21, which is designed to mutually connect the two supporting elements 3.

Advantageously, the stiffening cross-member 21 lies at right angles to the two supporting elements 3 in a proximate position with respect to said posts 5, so as to facilitate their movement, preventing it from interfering with the feet of the user during its movement.

Operation of the high chair according to the present invention is directly derivable from what has been described above.

In particular, it is evident that it is possible in a simple and intuitive manner, by acting on the actuation buttons 27, after disengaging the locking element 22, to slide the elongated elements 6*a* within the respective tubular elements 5*c*, moving the seat 7 toward the supporting surface 4.

Of course, once the selected height has been reached, the actuation button 27 is released, allowing the engagement of the locking tooth 22*b* with the insertion receptacle 23 arranged in a directly lower position.

If one wishes to move the seat 7 away from the supporting surface 4, it is sufficient to push upwardly on the coupling elements 6.

All the characteristics of the invention indicated above as advantageous, convenient or the like may also be omitted or be replaced with equivalents.

The invention thus conceived is susceptible of numerous modifications and variations, all of which are within the scope of the appended claims.

Thus, for example, the engagement element(s) 16 can be supported by the connecting portion 5*a* and, consequently, the respective engagement receptacles can be defined on the supporting element(s) 3.

Finally, nothing prevents connection elements from being provided between the supporting element(s) 3 and the respective post(s) 5, such connection elements allowing a relative roto-translation movement. Such connection elements can comprise, for example, lever means associated to connecting rods of the relative movement.

In practice it has been found that the invention has achieved the intended aim and objects in all of its embodiments.

The use of telescopic means and in particular the presence of the posts and of the respective coupling elements in fact allow in practice to provide a high chair in which the coupling elements themselves provide the upper portion of the high chair, thus allowing to lower and raise, together with the seat, the entire upper portion of the high chair.

In this manner, even when the seat is completely lowered, there are no portions of the supporting structure or of the high chair which lie above the seat, consequently eliminating any hindrance to the movements of the child or of the parent.

Another advantage of the invention resides in that thanks to the particular position of the rotary coupling axis of the seat it allows, when the back of the seat is reclined, to move backwardly the center of gravity of the seat much less than what occurs in the background art, ensuring greater stability against backward tipping.

In practice, the materials used, as well as the dimensions, may be any according to requirements.

All the details may further be replaced with other technically equivalent elements.

The disclosures in Italian Patent Application No. VR2006A000060 from which this application claims priority are incorporated herein by reference.

The invention claimed is:

1. A high chair, comprising a supporting structure, which is provided with at least one supporting element for resting on a supporting surface of the high chair, said at least one supporting element being rotatably connected to a lower end of at least one post arranged along a first longitudinal direction substantially starting from a first end portion of said at least one supporting element to define at least three resting regions, said at least one post supporting at an upper end thereof a respective coupling element which supports a seat which forms a sitting surface, means being provided for blocking said coupling element with respect to the respective post in order to adjust the distance between said seat and said at least one supporting element, said at least one supporting element being articulated so that it can rotate, substantially at said first end portion, to said at least one post in order to pass from an extended condition for use of the high chair, in which said at least one supporting element is angularly spaced with respect to the respective post and in which said at least one supporting element extends from said first end portion thereof to a second end portion thereof that is freely unattached from said post and arranged for engagement with the supporting surface of the high chair in said extended condition, to a folded condition in which said at least one supporting element is angularly closer to the respective post, the high chair further comprising locking means for locking a relative rotation between said supporting element and said post in the extended condition, said post being associated with an interconnection portion which forms, with the post, an acute angle and has an end pivoting portion arranged at said lower end thereof for pivoting to the first end portion of the supporting element, the high chair further comprising safety means which move said high chair to a folded condition if said locking means are not activated correctly, and said safety means comprising return means which act between said end pivoting portion and said supporting element, said return means comprising a spring element arranged for applying a force to said supporting element which tends to keep said high chair in the folded condition, said safety means comprising a center of gravity of the post-seat assembly, which is arranged between supporting feet and said end pivoting portions, said locking means comprising at least one engagement element, which is supported by at least one supporting element and is kinematically connected to the respective supporting foot, which can engage stably in a respective engagement receptacle which is formed in said post or in said interconnection portion with said high chair in the extended condition, said locking means comprising at least one actuation lever, which is supported by said post and is designed to disengage, when actuated, said at least one engagement element from the respective engagement receptacle, said actuation lever being actuatable only when the respective supporting element is raised from the supporting surface of the high chair, the high chair further comprising elastic loading means which act between said engagement element and an abutment region, which is supported by the respective supporting element, and are suitable to keep said engagement element stably engaged with the respective engagement receptacle when said high chair is in the extended condition, said supporting feet being supported rotatably, about a pivoting axis, by the respective supporting element, in order to pass from a locking condition, with said supporting foot rested on said supporting surface, to a release position, with said supporting foot raised from said supporting surface and turned about said pivoting axis, means for kinematic connection between said supporting feet and said engagement element being provided which are suitable to act, when said supporting feet are in the release position, in contrast with said elastic loading means in order to disengage said engagement element from the respective engagement receptacle, said supporting feet supporting a pin, which is connected to one end of said kinematic connection means which lies opposite the end connected to the respective engagement element and slidingly accommodated within a slot which is shaped like a circular arc which is centered on said pivoting axis and is formed at the end of said supporting element.

2. A high chair, comprising a supporting structure, which is provided with at least one supporting element for resting on a supporting surface of the high chair, said at least one supporting element being rotatably connected to a lower end of at least one post arranged along a first longitudinal direction substantially starting from a first end portion of said at least one supporting element to define at least three resting regions, said at least one post supporting at an upper end thereof a respective coupling element which supports a seat which forms a sitting surface, means being provided for blocking said coupling element with respect to the respective post in order to adjust the distance between said seat and said at least one supporting element, said at least one supporting element being articulated so that it can rotate, substantially at said first end portion, to said at least one post in order to pass from an extended condition for use of the high chair, in which said at least one supporting element is angularly spaced with respect to the respective post and in which said at least one supporting element extends from said first end portion thereof to a second end portion thereof that is freely unattached from said post and arranged for engagement with the supporting surface of the high chair in said extended condition, to a folded condition in which said at least one supporting element is angularly closer to the respective post, the high chair further comprising locking means for locking a relative rotation between said supporting element and said post in the extended condition, said post being associated with art interconnection portion which forms, with the post, an acute angle and has an end pivoting portion arranged at said lower end thereof for pivoting to the first end portion of the supporting element, the high chair further comprising safety means which move said high chair to a folded condition if said locking means are not activated correctly, and said safety means comprising return means which act between said end pivoting portion and said supporting element, said return means comprising a spring element arranged for applying a force to said supporting element which tends to keep said high chair in the folded condition, wherein said coupling element supports said seat so as to allow rotation of said seat about a rotary coupling axis, said locking means acting between said seat and said coupling element and locking the rotation of said seat with respect to said coupling element about said rotary coupling axis, which is substantially parallel and spaced with respect to said sitting surface on the side of a concavity of said sitting surface.

3. The high chair according to claim 2, wherein said rotary coupling axis lies substantially proximate to connection regions between said seat and a respective supporting table.

4. The high chair according to claim 2, wherein said rotary coupling axis is arranged substantially proximate to a free end of a crotch support which is associated with said seat.

5. The high chair according to claim 2, further comprising an actuation handle, which is arranged substantially at a back of said seat and is connected, by way of kinematic interconnection means, to said locking means.

6. The high chair according to claim 5, wherein said locking means comprise a retention body, which is monolithically rotationally associated with said seat and can be accommodated selectively within a plurality of complementarily shaped receptacles which are formed in said coupling element and are angularly spaced about said rotary coupling axis.

7. A high chair, comprising a supporting structure, which is provided with at least one supporting element for resting on a supporting surface of the high chair, said at least one supporting element being rotatably connected to a lower end of at least one post arranged along a first longitudinal direction substantially starting from a first end portion of said at least one supporting element to define at least three resting regions, said at least one post supporting at an upper end thereof a respective coupling element which supports a seat which forms a sitting surface, means being provided for blocking said coupling element with respect to the respective post in order to adjust the distance between said seat and said at least one supporting element, said at least one supporting element being articulated so that it can rotate, substantially at said first end portion, to said at least one post in order to pass from an extended condition for use of the high chair, in which said at least one supporting element is angularly spaced with respect to the respective post and in which said at least one supporting element extends from said first end portion thereof to a second end portion thereof that is freely unattached from said post and arranged for engagement with the supporting surface of the high chair in said extended condition, to a folded condition in which said at least one supporting element is angularly closer to the respective post, the high chair further comprising locking means for locking a relative rotation between said supporting element and said post in the extended condition, said post being associated with an interconnection portion which forms, with the post, an acute angle and has an end pivoting portion arranged at said lower end thereof for pivoting to the first end portion of the supporting element, the high chair further comprising safety means which move said high chair to a folded condition if said locking means are not activated correctly, and said safety means comprising return means which act between said end pivoting portion and said supporting element, said return means comprising a spring element arranged for applying a force to said supporting element which tends to keep said high chair in the folded condition, said at least one supporting element comprising a pair of supporting elements, each one of said pair of supporting elements being rotatably connected to a respective post of a pair of posts of said at least one post, said at least one coupling element comprising a pair of coupling elements, and the high chair further comprising telescopic means which act between a respective coupling element of said pair of coupling elements and the respective post and which are adapted to adjust a distance between said supporting elements and said seat, said telescopic means comprising a respective elongated element, which is monolithically associated with a respective coupling element and slidingly associated with a respective tubular portion supported by said respective post, and said locking means comprising at least one locking element, which can be controlled by an actuation button carried by a respective coupling element and provided with a locking tooth, which can engage selectively a plurality of insertion receptacles, which are formed in an engagement portion which is associated with the respective post and are spaced along said first longitudinal direction.

8. The high chair according to claim 7, wherein said engagement portion can be inserted in a containment slot formed in the respective post.

9. The high chair according to claim 7, wherein said at least one locking tooth is supported so that it can rotate by the respective coupling element about a supporting pin, elastic means being provided which are adapted to keep said locking tooth pressed against the respective engagement portion.

10. The high chair according to claim 7, wherein said insertion receptacles have an inclined portion and an abutment portion which is substantially perpendicular to said first longitudinal direction, so as to allow the sliding of the respective locking tooth with respect to the respective engagement portion when said coupling elements are moved away from said supporting elements and so as to prevent the mutual approach of said seat toward said supporting elements due to the engagement of said locking teeth with the respective abutment portions.

11. The high chair according to claim 10, further comprising a cross-member for interconnection between said pair of coupling elements.

12. The high chair according to claim 11, wherein said interconnection cross-member is U-shaped, with two end portions which, during use, lie along a substantially vertical direction, and an intermediate connecting portion, which during use lies along a substantially horizontal direction and is arranged below said seat.

13. The high chair according to claim 7, wherein said elongated element supports, so as to allow rotation about a fulcrum, a stop element which forms a stop head which is kept in contact with the respective engagement portion by means of the action of a spring, said stop head being adapted to slide on an engagement portion along both directions of relative sliding at least in a region affected by the presence of said insertion receptacles, there being, above said region affected by the presence of said insertion receptacles, an abutment which is directed toward said supporting elements and against which said stop head abuts so as to prevent disengagement of said elongated elements from the respective tubular portion.

14. The high chair according to claim 7, wherein said supporting elements comprise at least one respective supporting foot, which is arranged substantially at said second end portion.

15. The high chair according to claim 7, wherein said locking means comprise said supporting elements, which are mounted so that they can oscillate about a respective oscillation axis which is substantially perpendicular to the longitudinal axis of the respective supporting element, said safety means also being adapted to prevent the oscillation of said supporting elements when they are rested on the supporting surface.

16. The high chair according to claim 7, further comprising at least one stiffening cross-member, which is designed to mutually connect said two supporting elements.

17. The high chair according to claim 16, wherein said at least one stiffening cross-member runs at right angles to said two supporting elements in a position which lies proximate to said posts.

18. The high chair according to claim 1, wherein one of said supporting feet is associated with means for retention in said release position.

19. The high chair according to claim 1, wherein a slot extends along a longer portion so that, by way of the rotation of the respective supporting foot about a respective pivoting axis, a respective pin reaches a position in which said kinematic connection means are adapted to apply to the respective supporting foot a force which is directed so as to keep it stably in the release position.

20. The high chair according to claim 19, wherein said supporting element forms the end portion, which is arranged on the opposite side of said supporting foot with respect to the respective pivoting portion so as to form, when said high chair is in the folded condition, a rear supporting pad which is adapted to cooperate with a front supporting pad, which is rigidly coupled to said post in order to form a supporting base for said high chair in the folded condition.

21. The high chair according to claim 20, wherein said supporting foot has an elongated shape.

22. The high chair according to claim 20, wherein said front supporting pad comprises a freely rotating wheel whose axis is arranged in front with respect to the first longitudinal direction.

* * * * *